United States Patent [19]

Marchello

[11] Patent Number: 4,821,345

[45] Date of Patent: Apr. 18, 1989

[54] ATHLETIC EAR GUARD ASSEMBLY

[75] Inventor: John L. Marchello, Ann Arbor, Mich.

[73] Assignee: Danmar Products, Inc., Ann Arbor, Mich.

[21] Appl. No.: 114,568

[22] Filed: Oct. 29, 1987

[51] Int. Cl.[4] ..... A63B 71/10

[52] U.S. Cl. ..... 2/425; 2/412; 2/209

[58] Field of Search ..... 2/2, 410, 6, 411, 414, 2/417–425, 412, 16, 22, 209

[56] References Cited

U.S. PATENT DOCUMENTS

| | | | |
|---|---|---|---|
| 1,637,692 | 8/1927 | Fitzpatrick et al. | 2/423 |
| 1,714,275 | 5/1929 | Mullins | 2/425 |
| 1,970,130 | 8/1934 | Dickenson | 2/2 |
| 2,651,509 | 9/1953 | Hyman | 2/2 |
| 2,886,818 | 5/1959 | Roberts | 2/425 |
| 2,898,596 | 8/1959 | Keen | 2/425 |
| 3,311,921 | 4/1967 | Helm | 2/421 |
| 3,319,626 | 5/1967 | Lindsay | 2/2 |
| 3,327,316 | 6/1967 | Pukish, Jr. | 2/425 |
| 3,513,482 | 5/1970 | Holder | 2/425 |
| 3,990,220 | 12/1976 | Keltner | 2/2 |
| 4,279,037 | 7/1981 | Morgan | 2/421 |
| 4,307,471 | 12/1981 | Lovell | 2/425 |
| 4,551,861 | 11/1985 | Marchello | 2/425 |
| 4,700,403 | 10/1987 | Vacanti | 2/2 |
| 4,710,985 | 12/1987 | Dubner et al. | 2/425 |

*Primary Examiner*—Harvey C. Hornsby
*Assistant Examiner*—Joseph S. Machuga
*Attorney, Agent, or Firm*—Harness, Dickey & Pierce

[57] ABSTRACT

An improved ear guard assembly, particularly for amateur wrestlers. The ear guard includes a reinforcing plate member having head strap engaging slots with inner and outer sheet foam energy absorbing layers. The assembly is enclosed by a molded plastic skin cover having strap engaging apertures in registry with the strap engaging slots of the reinforcing plate which are reinforced to prevent tearing of the ear guards. The cover further has an inside peripheral surface which has ribs engaging the outer edge of the reinforcing plate to reduce the tendency for tearing of the cover by the plate edge. The outer cover preferably has a glossy outer surface, present a low coefficient of friction and a matte inner surface thereby aiding in retaining the ear guards in position on the wearer's head.

5 Claims, 3 Drawing Sheets

ATHLETIC EAR GUARD ASSEMBLY

BACKGROUND AND SUMMARY OF THE INVENTION

This invention relates to an athletic head gear device and particularly to a guard for protecting the ears of wrestlers during practice and contests.

Amateur wrestlers are subjected to maneuvers and contact with the wrestling mat that can damage their outer ear. As a means of protecting against such injury, ear guard devices are in wide-spread use which have an energy absorbing reinforced cup shaped protector covering the ears. The ear guard which is presently the most popular in use includes an inner metal reinforcing plate surrounded by an energy absorbing cover. The cover is formed by cutting sheet foam material to form a piece covering the outside of the plate and a ring shaped piece for the inside. The foam pieces are bonded together at their outer periphery and then coated with a plastic or rubber material by dipping. This process provides a smooth rubberized outer surface for the cover. The coated foam cover is then deformed to envelop the reinforcement plate. Although such ear guards perform satisfactorily, there is a need for improvements in their design and fabrication. The outer cover has cut-out areas which provide access for connection of the head straps to the reinforcing plate which retain the ear guards in position on the user's head. Since the ear guards must fit tightly and be positioned properly on the wearer, when the wrestler dons the head gear, he typically adjusts the position of the ear guards by placing his fingers in the cut-out areas of the outer cover thus pulling on the outer cover to move the ear guards. Over a prolonged period of time, the repeated stress on the outer cover caused by adjustment of ear guard position causes the outer surface layer of the cover to crack and tear, ultimately degrading the appearance and function of the device. The ends of the retaining straps are usually tucked underneath the cover adjacent the cut-outs. In order to change strap tension, the end of the strap has to be pulled from under the cover and adjusted, which further leads to cover tearing over time. Another shortcoming of present designs having coated pads is that manufacturers are unable to carefully control surface finish of the ear guard. A smooth outer surface and a roughened inner surface are desirable to reduce the tendency of the ear guard to move from its adjusted position when contacted by the mat or an opponent. Furthermore, since the cover is formed by bonded foam sheets, it is difficult to reinforce its inner peripheral edge which is desired to reduce the tendency of the outer edge of the reinforcement plate to cut through the foam pads.

The improved ear guard in accordance with this invention overcomes the above mentioned shortcoming of the described prior art design. The subject ear guard has a molded outer skin cover which is sufficiently resilient to enable it to be deformed to envelop a metal inner reinforcement plate. The cover has reinforced marginal areas around the head strap cut-outs to provide strength and resistance to cover tearing. Since the outer skin cover is holded, designers can easily provide variations in its surface finish for enhanced performance. The outer surface has a glossy finish providing low frictional engagement with the opponent and the wrestling mat. However, the portions of the cover in contact with the wearer's head have a matte finish which provides enhanced frictional engagement with the user, thus maintaining the ear guard in its adjusted position during use. The inner peripheral edge of the cover is ribbed where it engages the outer edge of the reinforcement plate to reduce the likelihood of cutting through the cover.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
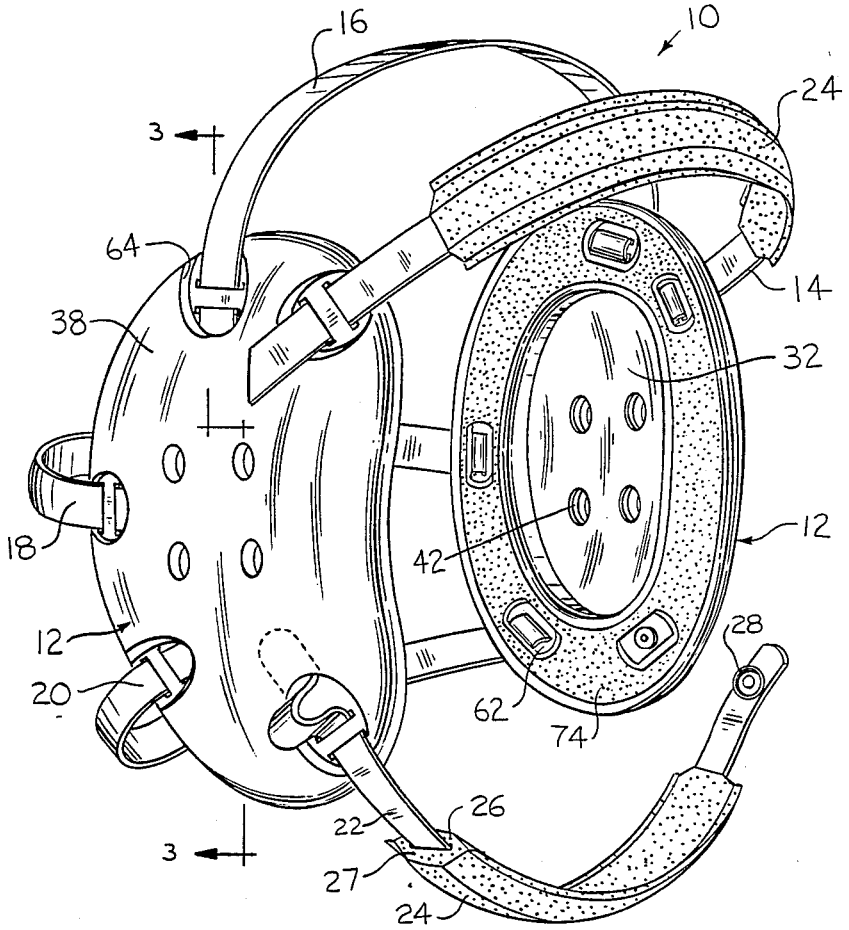
FIG. 1 is a pictorial view of an improved ear guard assembly in accordance with this invention.

An improved athletic ear guard assembly particularly adapted for wrestlers is shown pictorially in FIG. 1, and is generally designated there by reference number 10. Ear guard assembly 10 principally comprises a pair of ear guards 12, head straps 14, 16, 18, and 20, and chin strap 22. Straps 16 through 22 are typically formed of a reinforced plastic material. Head strap 14 and chin strap 22 include open cell foam pads 24 which absorbs perspiration and frictionally engages the wearer's forehead and chin to aid in maintaining ear guards 12 in position. Foam pads 24 are formed by stacking two foam layers 26 and 27, and heat fusing them together along their outer joining edges. Chin strap 22 includes snap fastener 28 for securing ear guard assembly 10 and allowing it to be removed.

Figure 2:
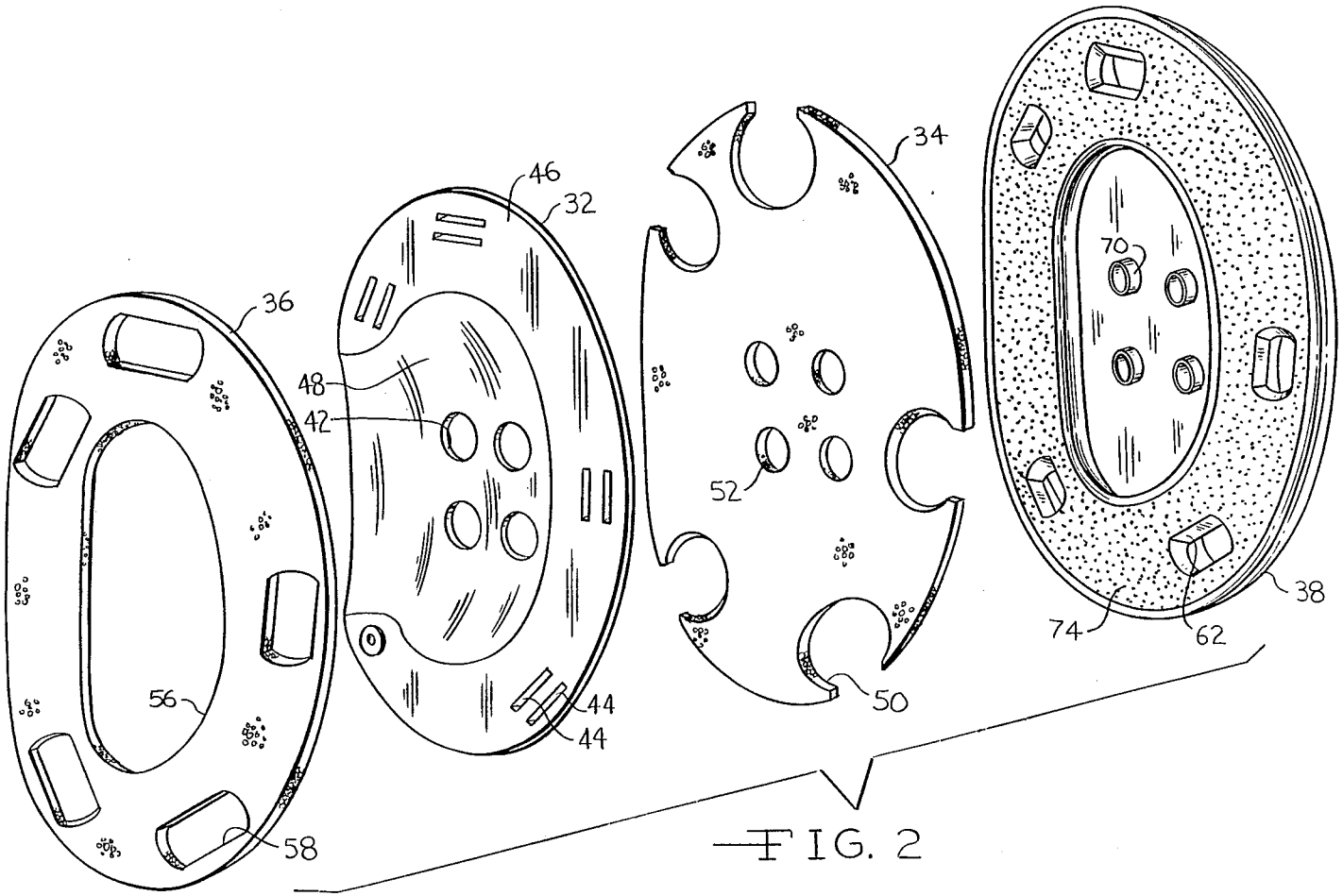
FIG. 2 is an exploded pictorial view of the ear guard assembly shown in FIG. 1, showing the outer cover, foam pads, and inner metal reinforcement.
Figure 4:
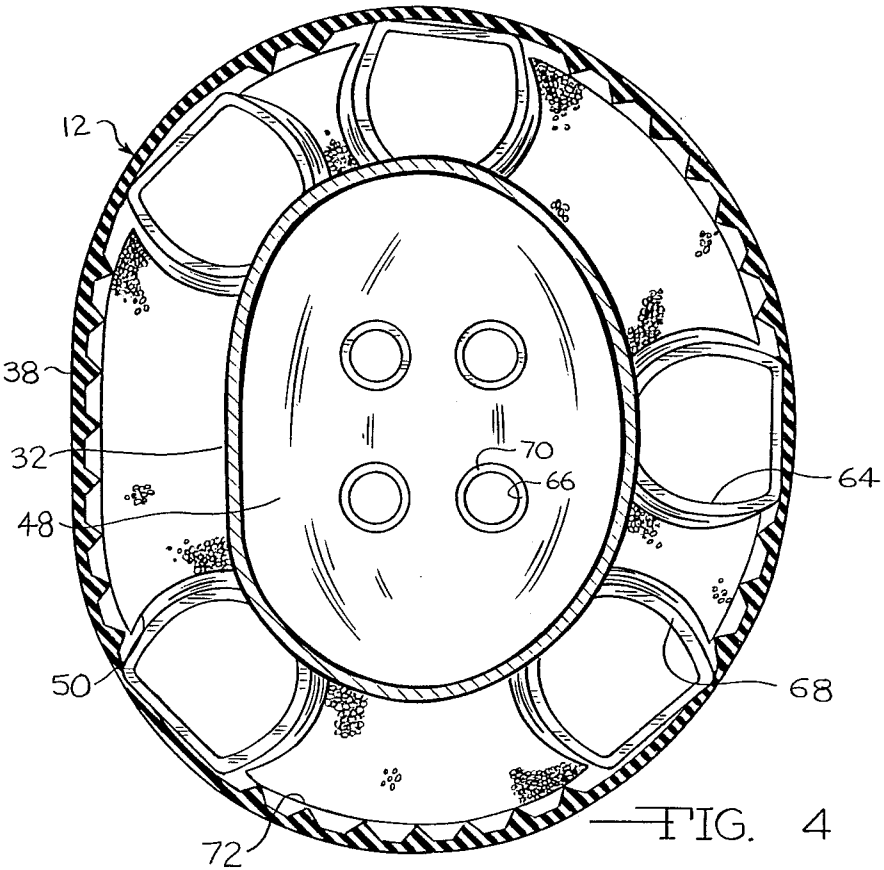
FIG. 4 is a cross-sectional view taken along the line 4—4 of FIG. 3.
Figure 3:
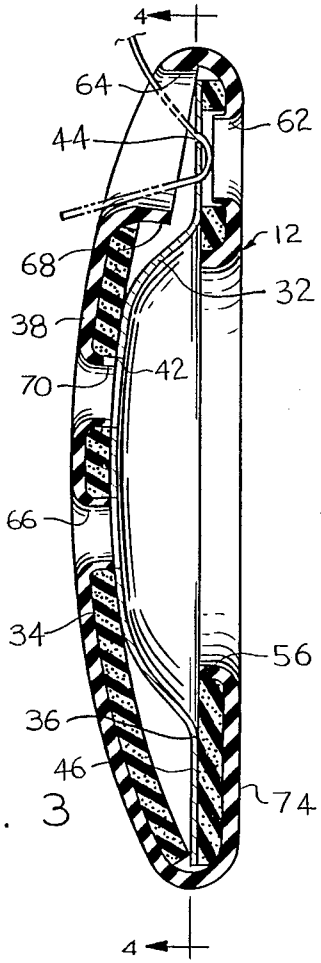
FIG. 3 is a cross-sectional view taken along line 3—3 of FIG. 1.

FIGS. 2 through 4 illustrate details of the construction of ear guards 12. Ear guards 12 include a rigid or semi-rigid reinforcing plate 32, outer foam pad 34, inner foam pad 36 and a molded outer skin cover 38.

Reinforcing plate 32 includes ear holes 42 for hearing and venting of the ear guard. Strap retention slots 44 are formed in the outer periphery of plate 32 and enable straps 14 through 22 to be retained, by feeding them into one slot and out of the other as shown in FIG. 1. Reinforcing plate 32 defines a cup shaped center 48, and marginal flange 46 conformed to fit against the wearer's head surrounding the ear. Outer foam pad 34 is shaped to overlie the outer surface of plate 32 and includes cut-outs 50 positioned to overlie strap retention slots 44, and further has ear hole cut-outs 52. Inner foam pad 36 is ring shaped and has a central cut-out 56 for ear clearance, and strap cut-outs 58, positioned in registry with slots 44 and cut-outs 50. Inner foam pad 36 and outer foam pad 34 are preferably formed from closed cell sheet foam material which is die-cut to the configurations illustrated.

Outer skin cover 38 may h=made from various plastic material such as vinyl, and is shaped to envelop foam pads 34 and 36, as shown in FIG. 3. Skin cover 38 defines a number of apertures including inside strap apertures 62, outside strap apertures 64, and ear holes 66.

The perimeter of each of apertures 64 and ear holes 66 is reinforced by flanges 68 and 70 which are turned in toward reinforcing plate 32. Flanges 68 and 70 also cover the edges of foam pads 34 and 36, thus protecting them and improving the aesthetic appearance of the assembly. The reinforcement provided by flanges 68 and 70 enables the outer cover 38 to resist tearing and failure when the wearer adjusts the positioning of the ear guards by pulling the cover at strap apertures 64.

As shown in FIG. 4, cover 38 further forms a plurality of radially inwardly projecting ribs or teeth 72 which contour the outer edge of reinforcing plate 32. Ribs 72 serve to distribute loading between the edge of plate 32 and cover 38 to prevent the edge from cutting through the cover. Since outer skin cover 38 is molded, its surface finish can be tailored as desired. The outer surface of cover 38 covering outer pad 34 has a high luster, extremely smooth surface which has low frictional engagement with the wrestling mat or an opponent. A circular band area 74 is formed with a matte finish on the outer surface of cover 38 covering inner pad 36 which frictionally engages the user's head thereby retaining the ear guards in position.

In use, straps 14 through 22 are fed into and out of strap retention slots 44. Inner pad strap cut-out 58 and cover inside strap apertures 62 provide clearance for the loop of strap material on the inside surface of reinforcement plate 32.

In a preferred assembly operation, foam pads 34 and 36 would be bonded by adhesives to the inside surfaces of cover 38, and this assembly would then be deformed to envelop plate 32. To facilitate bonding of pads 34 and 36, they could be made from sheet foam having one side with a self-stick pressure sensitive adhesive, covered by a peel off sheet.

While the above description constitutes the preferred embodiments of the present invention, it will be appreciated that the invention is susceptible to modification, variation and change without departing from the proper scope and fair meaning of the accompanying claims.

I claim:

1. An athletic ear guard assembly for covering and protecting a user's ears comprising:

a reinforcement plate having a cup shaped center section forming a convex outer surface and a concave inner surface, and forming a peripheral edge flange, said edge flange having a plurality of strap attaching means, a plurality of retention straps connected to said attaching means and enabling said ear guard assembly to be held in position on a user's head, an outer foam pad having a shape complementary to said plate and covering said convex outersurface of said plate, said outer foam pad having cut-out areas overlying said strap attaching means, an inner foam pad covering said edge flange on said plate inner surface, and a molded outer skin cover covering said foam pads, said cover having apertures overlying said outer foam pad cut-outs and said strap attaching means and forming reinforcing flanges surrounding said cut-outs which cover the edges of said outer foam pad defining said cut-out areas, said outerskin cover further forming internal ribs around the periphery of said cover engaging the outer edge of said plate, said ribs engaging said plate outer edge to inhibit tearing of said outer cover by said plate edge.

2. An athletic ear guard assembly according to claim 1 wherein the portion of said cover covering said outer foam pad has a smooth exterior surface to thereby reduce its coefficient of friction, and the portion of said cover covering said inner foam pad has a matte exterior finish for frictional engagement with the user.

3. An athletic ear guard assembly according to claim 1 further comprising a resilient pad surrounding at least one of said straps which provides a high coefficient of friction against auser, said pad formed from two straps of open-celled foam which are heat fused along their outer edges.

4. An athletic ear guard assembly according to claim 3 wherein said inner foam pad has apertures overlying said slots to provide clearance for a loop of said strap.

5. An athletic ear guard assembly according to claim 4 wherein the portion of said cover covering said inner foam pad has apertures overlying said slots to provide clearance for said straps.

* * * * *